United States Patent [19]

Berry et al.

[11] Patent Number: 4,871,073

[45] Date of Patent: Oct. 3, 1989

[54] DISC SCREEN SEPARATOR DEVICE

[75] Inventors: John R. Berry, Cockeysville; David N. Chon, Baltimore, both of Md.

[73] Assignee: National Ecology, Inc., Timonium, Md.

[21] Appl. No.: 103,963

[22] Filed: Oct. 2, 1987

[51] Int. Cl.[4] ..... B07B 1/16

[52] U.S. Cl. ..... 209/672; 209/931

[58] Field of Search ..... 209/667, 671, 672, 931

[56] References Cited

U.S. PATENT DOCUMENTS

| | | | |
|---|---|---|---|
| 622,035 | 3/1899 | Bray | 209/672 X |
| 1,677,838 | 7/1928 | Molin | 209/672 |
| 1,699,718 | 1/1929 | Robins | 209/672 |
| 1,899,737 | 2/1933 | Ulrich | 209/672 |
| 2,588,309 | 3/1952 | Troyer | 209/667 |
| 2,670,846 | 3/1954 | Rienks et al. | 209/672 X |
| 2,699,253 | 1/1955 | Miller | 209/672 |
| 4,452,694 | 6/1984 | Christensen et al. | 209/667 X |
| 4,653,648 | 3/1987 | Bielagus | 209/672 |

FOREIGN PATENT DOCUMENTS

| | | | |
|---|---|---|---|
| 0640551 | 1/1937 | Fed. Rep. of Germany | 209/672 |

*Primary Examiner*—Johnny D. Cherry

*Assistant Examiner*—Edward M. Wacyra

*Attorney, Agent, or Firm*—Jon C. Winger

[57] ABSTRACT

A disc screen separator device for separating or classifying materials. The disc screen separator device includes a plurality of parallel, spaced apart corotating shafts each having a plurality of spaced apart separator discs mounted thereon for rotation therewith. The separator discs on adjacent shafts are interspaced. A plurality of spacers are located between adjacent separator discs on each shaft to maintain the spacing between adjacent separator discs on each shaft. Both the separator discs and spacer discs are fabricated of a resilient material.

In an alternative embodiment, a disc screen separator device includes a plurality of sets of first shafts, the shafts of the sets of first shafts being parallel, spaced apart, and corotating with a plurality of spaced apart separator discs mounted on the first shafts for rotation therewith. A second shaft is located in the interval between sets of first shafts with a plurality of agitator discs mounted on the second shafts for rotation therewith. The agitator discs on the second shafts are interspaced with the separator discs on the first shafts of the shaft sets adjacent to the second shaft.

9 Claims, 2 Drawing Sheets

110
112
114
116
118
120
121
122
123
124
128
138
142
144
146
148
130
38
28
30
"A"
"B"
"C"
"D"
4

DISC SCREEN SEPARATOR DEVICE

BACKGROUND OF THE INVENTION

The present invention relates to an apparatus for separating or classifying material, and more particularly, to a disc screen separator having rows of corotating separator discs wherein a heterogeneous mixture of material is fed onto the top surface of the separator device over the separator discs at one end of the separator. Undersized material falls through the spaces between the discs as oversized material is conveyed from row to row of separator discs as the material moves toward the other end of the separator.

Various disc screen separator devices are known. One problem with such disc screen separators heretofore known to us is that portions of the material being separated which are too large to pass through the spaces between the separator discs sometimes becomes loosely trapped in the space between separator discs causing noise and also plugging the spaces whereupon the trapped material can block the flow of following material across the separator. Another problem is that portions of the material being separated can be tightly lodged in the space between separator discs and tend to damage the spacers or stall the rotation of the separator disc causing an interruption of the screening process.

SUMMARY OF THE INVENTION

It is an object of the present invention to provide a disc screen separator device which minimizes the chances of having portions of the material from becoming both loosely trapped and tightly lodged in the spaces between separator discs.

It is another object to provide a disc screen separator device which minimizes the chances of damage to the separator spacers and other components of the separator device in the event portions of the material do become loosely trapped or tightly lodged in the spaces between separator discs.

It is a further object of the present invention to provide for periodically accelerating, lifting and agitating the material being separated as it moves over the separator discs from the feed end to the discharge end of the disc screen separator device.

It is still another object of the present invention to prevent the blocking or blinding of the openings in the disc screen separator due to loosely trapped particles.

More particularly, the present invention provides a disc screen separator with improved screening efficiency which, in one embodiment, comprises a frame structure, a plurality of spaced apart, parallel shafts journal mounted to the frame structure, a plurality of separator discs mounted on each shaft coaxial with the shaft and, coaxial with each other, and for rotation with the shaft, the separator discs on each shaft being spaced from adjacent separator discs on the same shaft along the longitudinal axis of the shaft, each separator disc being fabricated of a resilient material, and each separator disc having a serrated periphery, a plurality of spacers mounted on each shaft coaxial with the shaft, coaxial with the separator discs, and coaxial with each other, and for rotation with the shafts, the spacers being located between adjacent separator discs to maintain the space between adjacent separator discs, each spacer being fabricated of a resilient material, and each separator disc having a serrated periphery and the separator discs on each shaft are interspaced with the separator discs on adjacent shafts with the separator discs in alignment with the spacers, and with the serrated periphery of the separator discs being spaced from the serrated periphery of the spacers in the interspace of the separator discs on adjacent shafts.

In another embodiment, the present invention provides a disc screen separator device comprising a frame structure, a plurality of sets of first shafts, the shafts of each set being spaced apart and parallel to each other and journal mounted to the frame structure, the sets of shafts being spaced from each other by an interval larger than the space between adjacent shafts of the sets, a second shaft located in each interval between sets of shafts with the space between the second shaft and an adjacent one of the first shafts of the sets adjacent thereto being larger than the spacing between adjacent ones of the first shafts of the sets, a plurality of separator discs mounted on each first shaft coaxial with the first shaft and coaxial with each other, and for rotation with the shaft, the separator discs on each shaft being spaced from adjacent separator discs on the same shaft along the longitudinal axis of the shaft, a plurality of first spacers mounted on each first shaft coaxial with the shaft, coaxial with the separator discs, and coaxial with each other, and for rotation with the shaft, the first spacers being located between adjacent separator discs to maintain the space between adjacent separator discs, the separator discs on each first shaft of a set are interspaced with the separator discs on adjacent shafts of the same set, a plurality of agitator discs mounted on the second shaft coaxial with the second shaft and coaxial with each other, and for rotation with the second shaft, the agitator discs being spaced from adjacent agitator discs along the longitudinal axis of the shaft, a plurality of second spacers mounted on the second shaft coaxial with the second shaft, coaxial with the agitator discs, and coaxial with each other, and for rotation with the second shaft, the second spacers being located between adjacent agitator discs to maintain the space between adjacent agitator discs and, the agitator discs on the second shaft are interspaced with the separator discs on those first shafts of the shaft sets which are adjacent to the second shaft.

DESCRIPTION OF THE DRAWINGS

A better understanding of the present invention will be had upon reference to the following specification in conjunction with the accompanying drawings in which like numerals are used throughout the several views to denote like parts and wherein.

DETAILED DESCRIPTION OF THE PREFERRED EMBODIMENTS

Figure 1:
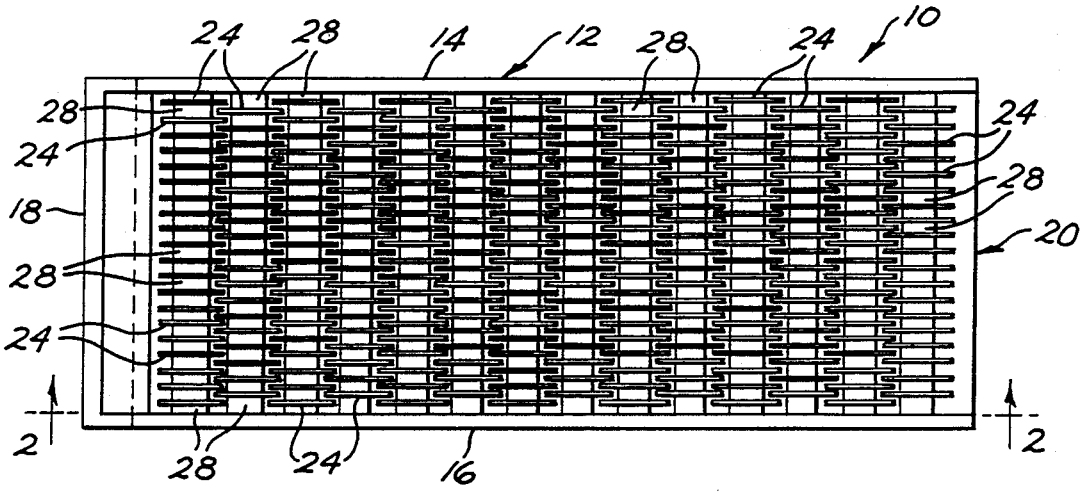
FIG. 1 is a schematic plan view of one embodiment of a disc screen separator device incorporating various features of the present invention.
Figure 2:
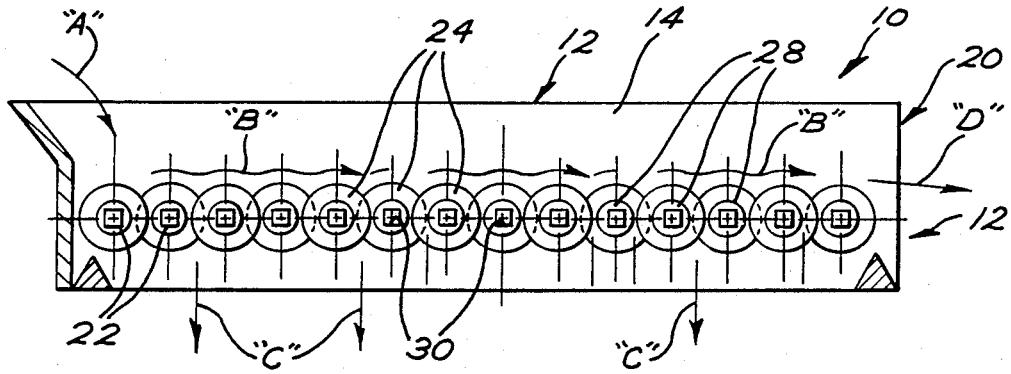
FIG. 2 is a schematic side view of the disc screen separator device of FIG. 1 as seen in the direction of arrows 2—2 in FIG. 1.

With reference to FIGS. 1 and 2, there is illustrated one embodiment of a disc screen separator device, generally denoted as the numeral 10, of the present invention. The disc screen separator device 10 includes a frame structure 12. The frame structure 12 is illustrated in plan view as being a generally rectangular peripheral structure having longitudinal side rails 14 and 16, a transverse end rail 18 at the upstream or loading end of the device 10 and an open discharge or downstream end 20. A plurality of spaced apart, parallel shafts 22 are journal mounted to the frame structure 12. As shown, the shafts 22 extend between the frame longitudinal rails 14 and 16 and are journal mounted by appropriate bearings (not shown) at their opposite ends to the longitudinal side rails 14 and 16. As shown in FIG. 2, the shafts 22 are square in transverse cross-section.

A plurality of separator discs 24 are mounted on each of the shafts 22. The separator discs 24 are coaxial with the shaft 22 and coaxial with each other. The separator discs 24 are mounted to the shafts 22 for rotation with the shafts. Toward this objective, the separator discs 24 have a coaxial square bore 26 which is of an appropriate size to receive the square shafts 22 therethrough with a slip fit. The separator discs 24 on each shaft 22 are spaced from adjacent separator discs 24 on the same shaft 22 along the longitudinal axis of the shaft 22. Thusly, the separator discs 24 on each shaft 22 are mutually parallel and perpendicular to the shaft 22.

A plurality of spacers 28 are mounted on each shaft 22 coaxial with the shaft 22, coaxial with the separator discs 24, and coaxial with each other. The spacers 28 are mounted on the shaft 22 for rotation with the shafts. As with the separator discs 24, the spacers 28 have a coaxial square bore 30 which is of an appropriate size to receive the square shafts 22 therethrough with a slip fit. The spacers 28 are located between adjacent separator discs 24 to maintain the space between adjacent separator discs 24. Thusly, the spacers 28 on each shaft 22 are mutually parallel, parallel to the separator discs 24 on the same shaft 22 and perpendicular to the shaft 22.

The separator discs 24 on each shaft 22 are interspaced with the separator discs 24 on adjacent shafts 22 with the separator discs 24 in alignment with the spacers 28 in the interspace of the separator discs 24 on the adjacent shafts 22.

Figure 5:
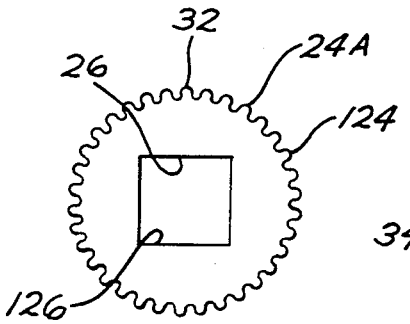
FIG. 5 is a view of a separator disc used in the separator disc screen device of the present invention.
Figure 6:
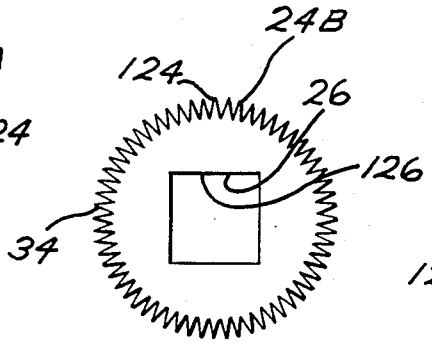
FIG. 6 is a view of a segment of another separator disc used in the disc screen separator device of the present invention.
Figure 7:
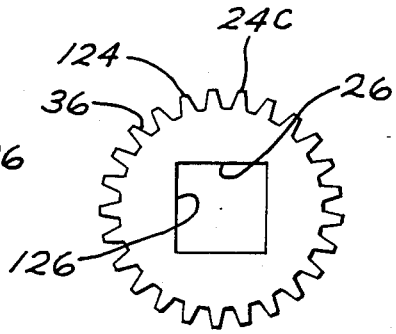
FIG. 7 is a view of a segment of a further separator disc used in the disc screen separator device of the present invention.

With reference to FIGS. 5, 6 and 7, there is shown three somewhat different embodiments of a separator disc denoted as 24A, 24B and 24C, respectively. The separator discs 24 are fabricated of a resilient, flexible material such as, for example, neoprene, rubber, urethane, and the like. In addition, the periphery of the separator discs 24 are serrated. As shown in FIG. 5 the serrations are in the form of a series of smoothly curved radial projections 32, in FIG. 6 the serrations are in the form of a series of pointed triangular radial projections 34, and in FIG. 7 the serrations are shown as truncated or blunt ended radial projections 36.

Figures 3, 4, 8, 9:
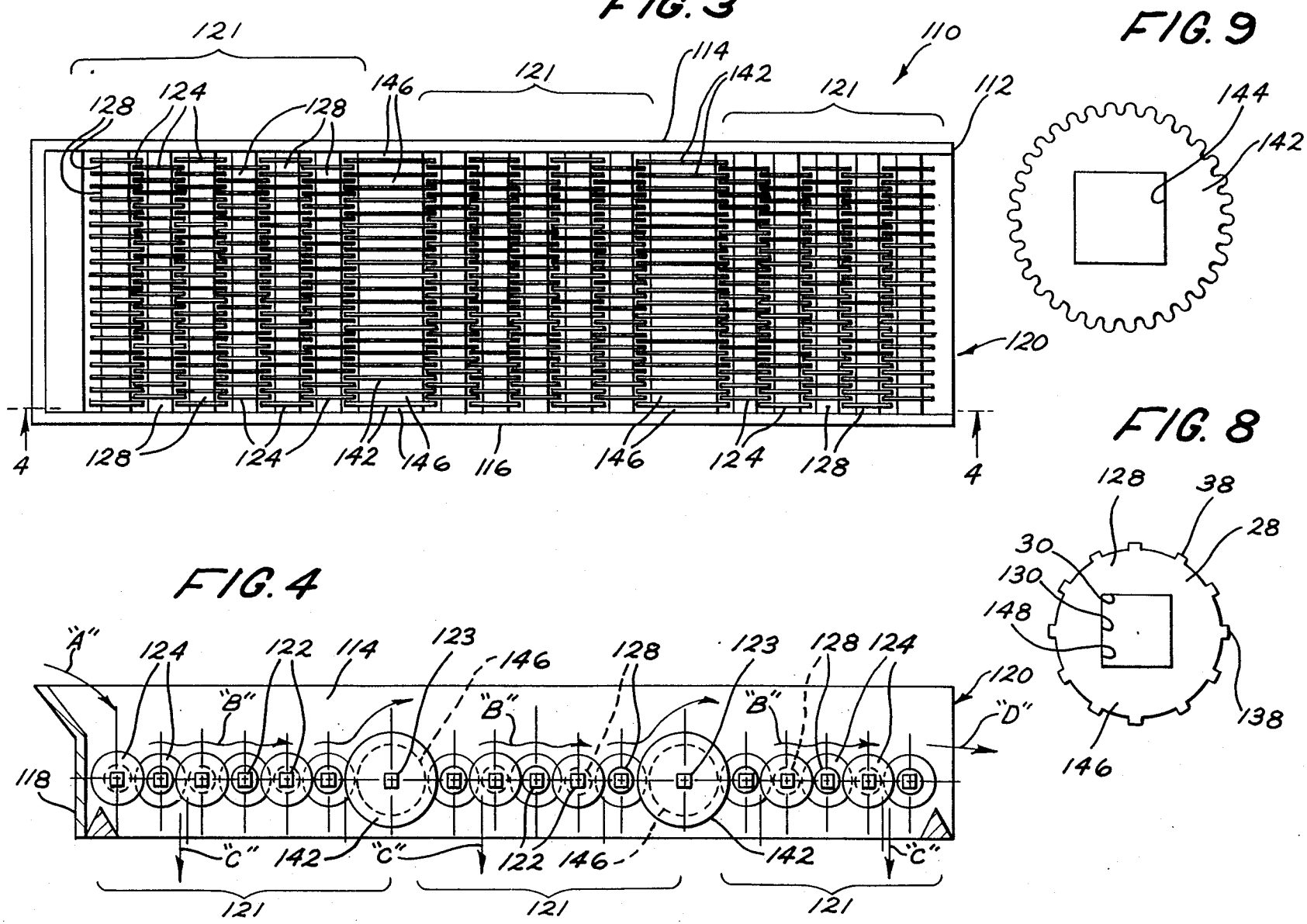
FIG. 3 is a schematic plan view of another embodiment of a disc screen separator device incorporating various features of the present invention.
FIG. 4 is a schematic side view of the disc screen separator device of FIG. 3 as seen in the direction of arrows 4—4 in FIG. 3.
FIG. 8 is a view of a spacer used in the disc screen separator device of the present invention.
FIG. 9 is a view of an agitator disc used in the disc separation device of FIGS. 3 and 4.

With reference to FIG. 8, there is shown a spacer 28 having a serrated periphery. The serrated periphery is in the form of truncated blunt ended radial projections 38 spaced apart from each other about the circumference of the spacers 28. However, it should be understood that the serrated periphery of the spacers 28 can be of other configurations such as a series of smoothly curved radial projections or pointed radial projections. The spacers 28 are fabricated of a resilient, flexible material such as, for example, neoprene, rubber, urethane, and the like.

With reference once again to FIG. 1, the separator discs 24 on each shaft 22 are interspaced with the separator discs 24 on adjacent shafts 22 and, therefore, have their serrated peripheral edges spaced from the serrated peripheral edges of the spacers 28 in the interspace of the separator discs 24 on adjacent shafts 22.

Now with reference to FIGS. 3 and 4, there is shown a disc screen separator device, generally denoted as the numeral 110, of the present invention which is similar in most respects to the disc screen separator device 10. The disc screen separator device 110 includes a frame structure 112 illustrated in plan view as being generally rectangular having spaced apart longitudinal side rails 114 and 116, a transverse end rail 118 at the upstream end of the device 110 and an open discharge or downstream end 120.

A plurality of sets 121 of first shafts 122 are located on the frame structure 112. The first shafts 122 of each set 121 are spaced apart and parallel to each other, and are journal mounted to the frame structure 112. As shown, the shafts 122 extend between frame longitudinal rails 114 and 116, and are journal mounted by appropriate bearings (not shown) at their opposite ends to the longitudinal side rails 114 and 116. As shown in FIG. 4, the shafts 122 are square in transverse cross-section. The sets 121 of first shafts are spaced from each other by an interval larger than the space between adjacent shafts 122 of the sets 121. As shown in FIGS. 3 and 4, there are three sets 121 of first shafts, one set 121 at each end of the frame structure 112 and another set 121 spaced equal distance between the two end sets 121.

A second shaft 123 is located in each interval between sets 121 of first shafts 122. The second shafts 123 are parallel to the first shafts 122, extend between the frame longitudinal rails 114 and 116, and are journal mounted by appropriate bearings (not shown) at their opposite ends to the longitudinal side rails 114 and 116. The space between the second shaft 123 and adjacent one of the first shafts 122 of the sets 121 adjacent thereto are larger than the spacing between adjacent ones of the first shaft 122 of the sets 121. As shown in FIG. 4, the space between the second shaft 123 and adjacent ones of the first shaft 122 is about half again as large as the space between adjacent first shafts 122 of the sets 121.

A plurality of separator discs 124 are mounted on each of the first shafts 122. The separator discs 124 are coaxial with the first shaft 122 and mounted to the first shafts 122 for rotation with the shafts 122. Toward this objective, the separator discs 124 have a coaxial square bore 126 which is of an appropriate size to receive the square shafts 122 therethrough with a slip fit. The separator discs 124 on each first shaft 122 are spaced from adjacent separator discs 124 on the same shaft 122 along the longitudinal axis of the shaft 122. Thusly, the separator discs 124 on each shaft 122 are mutually parallel and perpendicular to the shaft 122.

A plurality of first spacers 128 are mounted on each first shaft 122 coaxial with the shaft 122, coaxial with the separator discs 124, and coaxial with each other. The first spacers 128 are mounted on the first shafts 122 for rotation with the shafts. As with the separator discs 124, the first spacers 128 have a coaxial square bore 130 which is appropriately sized to receive the square first shaft 122 therethrough with a slip fit. The first spacers 128 are located between adjacent separator discs 124 to maintain the space between adjacent separator discs 124. Therefore, the first spacers 128 on each first shaft 122 are mutually parallel, parallel to the separator discs 124 on the same shaft 122, and perpendicular to the first shaft 122.

The separator discs 124 on each first shaft 122 of a set 121 are interspaced with the separator discs 124 on adjacent first shafts 122 of the same set 121 with the separator discs 124 in alignment with the first spacer 128 in the interspace of the separator discs 124 on the adjacent first shaft 122.

A plurality of agitator discs 142 are mounted on each of the second shafts 123. The agitator discs 142 are coaxial with the second shaft 123 and coaxial with each other. The agitator discs 142 are mounted on the second shafts 123 for rotation with the shafts 123. Toward this objective, the agitator discs 142 have a coaxial square bore 144 which is of an appropriate size to receive the square second shaft 123 therethrough with a slip fit. The agitator discs 142 on each second shaft 123 are spaced from adjacent agitator discs 142 on the same shaft 123 along the longitudinal axis of the second shaft 123. Therefore, the agitator discs 142 on each second shaft 123 are mutually parallel and perpendicular to the second shaft 123.

A plurality of second spacers 146 are mounted on each second shaft 123 coaxial with the shaft 123, coaxial with the agitator discs 142, and coaxial with each other. The second spacers 146 are mounted on the second shafts 123 for rotation with the second shafts 123. The second spacers 146 can have a peripheral configuration identical with the peripheral configuration of the first spacers 128 and have a square bore 148 which is appropriately sized to receive the square second shaft 123 therethrough with a slip fit. The second spacers 16 are located between adjacent agitator discs 142 to maintain the space between adjacent agitator discs 142. Therefore, the second spacers 146 on each second shaft 123 are mutually parallel, parallel to the agitator discs 124 on the same second shaft 123, and perpendicular to the second shaft 123.

The agitator discs 142 on each second shaft 123 are interspaced with the separator discs 124 on the first shafts 122 of the sets 121 of second shafts 122 adjacent to the second shaft 123.

As can be best seen in FIG. 4, the agitator discs 142 have a larger circumferential dimension than the separator discs 124. As shown, the agitator discs 142 have a circumference which is about twice the circumference of the separator discs 124. Therefore, even with the agitator discs 142 being driven at the same rotational speed as the separator discs 124, they will have a faster peripheral speed. With reference to FIG. 9, there is shown an agitator disc 142 having a serrated periphery. As shown, the serrations are in the form of a continuous series of smoothly curved radial projections 150. The peripheral serrations can be other shapes such as the various shapes of the serrated periphery of the separator discs 24 shown in FIGS. 6 and 7. The agitator discs 142 are also fabricated of a resilient, flexible material such as, for example, neoprene, rubber, urethane, and the like. The separator discs 124 of the disc screen separator device 110 are virtually identical to the separator discs 24 of the disc screen separator device 10. Therefore, with reference to FIGS. 5, 6 and 7, the separator disc 124 has a serrated periphery as does the separator disc 24. The separator discs 124 are also fabricated of a resilient flexible material such as, for example, neoprene, rubber, urethane, and the like.

The first spacers 128 and second spacers 146 of the disc screen separator device 110 have virtually identical peripheral configurations to each other and are virtually identical to the spacers 28 of the disc screen separator device 10 except that the circumference of the second spacers 146 is larger than the circumference of the first spacers 128. Therefore, with reference to FIG. 8, the first spacer 128 and second spacer 146 have a serrated periphery and are fabricated of a resilient, flexible material such as, for example, neoprene, rubber, urethane, and the like.

In operation of the disc screen separator device 10, material to be separated is deposited over the separator discs 24 at one end (the feed end) of the device 10 as indicated by the arrow "A" in FIG. 2. The rotating separator discs 24 move the material toward the opposite end 20 (discharge end) of the device as indicated by the arrows "B" in FIG. 2. As the material moves from the feed end to the discharge end of the device 10, undersized material drops through the openings between the interspaced separator discs 24 and spacers 28 as indicated by the arrows "C" in FIG. 2. In the event that some of the material becomes loosely trapped or tightly lodged in the openings between interspaced separator discs 24 and spacers 28, the serrated periphery of the spacers 28 will engage the material and either push it downwardly causing the separator discs 24 to deflect due to their resilient flexible construction increasing the size of the opening between interspaced separator discs 24 allowing the material to move downwardly therethrough, or lift the material back onto the top of the separator discs 24 on the next adjacent shaft. In addition, some of the material loosely trapped or tightly lodged in the openings between interspaced separator discs 24 will be engaged by the serrated periphery of the separator discs 24 and will be lifted back onto the top of the separator discs on the next adjacent shaft. The oversized material then is discharged from the top of the separator discs 24 as indicated by the arrows "D" at the discharge end 20 of the separator device 10.

In operation of the disc screen separator 110, material to be separated is deposited over the separator disc 124 at one end (the feed end) of the device 110 as indicated by the arrow "A" in FIG. 4. The rotation separator discs 124 move the material to the opposite end 20 (discharge end) of the device 110 as indicated by the arrows "B" in FIG. 4. As the material moves from the feed end to the discharge end of the device 110, undersized material drops through the openings between the interspaced separator discs 124 and first spacers 128 as indicated by the arrows "C" in FIG. 4. In the event that some of the material becomes loosely trapped or even tightly lodged in the openings between the interspaced separator discs 124, the serrated periphery of the spacers will engage the material and either push it downwardly causing the seprator discs 124 to deflect due to their resilient, flexible construction increasing the size of the openings between interspaced separator discs 124 allowing the material to move downwardly therethrough, or lift the material back onto the top of the separator discs 124 on the next adjacent shaft. In addition, some of the material in the openings between interspaced separator discs 124 will be engaged by the serrated periphery of the separator discs 124 and will be lifted back onto the top of the separator discs on the next adjacent shaft. As the material progresses to the agitator discs 142, the serrated periphery of the agitator discs 142 will engage the material and accelerate its movement therepast due to their higher peripheral velocity. In addition, if some material becomes loosely trapped or tightly lodged in the openings between the interspaced separator discs 124 and agitator discs 142, the separator discs 124 and agitator discs can deflect due to their resilient, flexible construction increasing the size of the opening allowing the material to move downwardly therethrough.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A disc screen separator device comprising:

a frame structure;

a plurality of sets of first shafts, the shafts of each set being spaced apart and parallel to each other and journal mounted to the frame structure, the sets of shafts being spaced from each other by an interval larger than the space between adjacent shafts of the sets;

a second shaft located in each interval between sets of first shafts with the space between the second shaft and adjacent ones of the first shafts of the sets adjacent thereto being larger than the spacing between adjacent ones of the first shafts of the sets;

a plurality of separator discs mounted on each first shaft coaxial with the first shaft and coaxial with each other, and for rotation with the first shaft, the separator discs on each first shaft being spaced from adjacent separator discs on the same first shaft along the longitudinal axis of the first shaft;

a plurality of first spacers mounted on each first shaft coaxial with the first shaft, coaxial with the separator discs, and coaxial with each other, and for rotation with the first shaft, the first spacers being located between adjacent separator discs to maintain the space between adjacent separator discs;

the separator discs on each first shaft of a set are interspaced with the separator discs on adjacent first shafts of the same set;

a plurality of agitator discs mounted on the second shaft coaxial with the second shaft and coaxial with each other, and for rotation with the second shaft, the agitator discs being spaced from adjacent agitator discs along the longitudinal axis of the second shaft;

a plurality of second spacers mounted on the second shaft coaxial with the second shaft, coaxial with the agitator discs, and coaxial with each other, and for rotation with the second shaft, the second spacer discs being located between adjacent agitator discs to maintain the space between adjacent agitator discs; and, the agitator discs on the second shaft are interspaced with the separator discs on the first shafts of the shaft sets adjacent to the second shaft.

2. The disc screen separator device of claim 1, wherein the agitator discs have a circumferential dimension larger than the circumferential dimension of the separator discs.

3. The disc screen separator device of claim 2, wherein the agitator discs each have a serrated periphery.

4. The disc separator device of claim 3, wherein the agitator discs are fabricated of a resilient material.

5. The disc screen separator device of claim 2, wherein the distance between the peripheries of the aligned separator discs and second spacers is substantially equal to the distance between the peripheries of the aligned agitator discs and first spacers.

6. The disc screen separator device of claim 1, wherein the second spacers have a circumferential dimension larger than the circumferential dimension of the first spacers.

7. The disc screen separator device of claim 1, wherein each second spacer has a serrated periphery.

8. The disc screen separator device of claim 1, wherein the second spacers are fabricated of a resilient material.

9. The disc screen separator of claim 1, wherein the spacing between adjacent agitator discs on the second shaft is substantially equal to the spacing between adjacent separator discs on the first shafts.

* * * * *